United States Patent [19]

Friedman

[11] Patent Number: 4,557,717

[45] Date of Patent: Dec. 10, 1985

[54] CUP INSERT FOR BALANCING

[75] Inventor: Leonard I. Friedman, Silver Spring, Md.

[73] Assignee: American National Red Cross, Washington, D.C.

[21] Appl. No.: 420,301

[22] Filed: Sep. 20, 1982

[51] Int. Cl.[4] ..... B04B 9/14

[52] U.S. Cl. ..... 494/10; 494/17; 494/27; 494/37

[58] Field of Search ..... 210/514, 518, 927, DIG. 24; 494/10, 23, 27, 37, 44, 85, 17; 220/445, 446

[56] References Cited

U.S. PATENT DOCUMENTS

| | | | |
|---|---|---|---|
| 2,351,708 | 6/1944 | Rubisson | 494/12 |
| 2,526,165 | 10/1950 | Smith . | |
| 2,929,221 | 3/1960 | Clauson | 220/445 |
| 3,851,817 | 12/1974 | Buck | 494/14 |
| 3,921,898 | 11/1975 | Finkel | 494/26 |
| 4,092,113 | 5/1978 | Hardy | 494/10 |

*Primary Examiner*—Robert W. Jenkins
*Assistant Examiner*—Arthur D. Dahlberg
*Attorney, Agent, or Firm*—Holman & Stern

[57] ABSTRACT

A centrifuge cup insert having an outer container and an inner container disposed therein with a spacer means between the containers to afford a reservoir between the containers capable of holding a liquid, the reservoir communicating with the atmosphere; associated apparatus for weighing the cup insert and dispensing a metered amount of fluid into the reservoir; and a method of using the cup insert with or without the associated apparatus.

10 Claims, 18 Drawing Figures

CUP INSERT FOR BALANCING

FIELD OF THE INVENTION

This invention relates to an apparatus, and a method for its use, for balancing a centrifuge in which a plurality of specimens are treated simultaneously.

BACKGROUND OF THE INVENTION

When spinning a plurality of different specimens in a centrifuge, it is critical that the weights of the specimens be approximately equalized to avoid the creation of unbalanced tangential (centrifugal) forces, which prevent smooth operation of the centrifuge a which may damage its bearings or even result in an "explosion". Similarly, the specimen must be placed approximately equidistant from each other around the circumference of the centrifuge plate.

Larger laboratory centrifuges such as those used in blood banks for component preparation usually have four or six cups arranged on pivots all located in a single plane perpendicular to and passing through the central axis of the centrifuge, each pivot itself being perpendicular to the central axis. To facilitate the handling of the specimens, cup inserts are provided. These inserts are of uniform configuration and weight, and specimens are generally placed into a cup insert and the specimen and insert then placed in the cup.

Where a variable amount of specimen is available or may be centrifuged, balancing of the cups is achieved very simply by using identical aliquots. However, this is not possible where fixed amounts of different specimens are to be centrifuged or where the different specimens have differing masses, or where the specimens are each in sealed containers, such as whole blood.

The centrifuging of whole blood, which is exemplary of this invention but not limiting, has produced certain laboratory practices which best illustrate the problem.

In centrifuging whole blood during blood component preparation, each donor's blood sample is kept in a separate bag during processing. This is to permit separate recovery of different types of blood products, to maintain sterility, and to prevent contamination of other donor's blood by a sample containing, for example, hepatitis virus.

The whole blood is kept in the same flexible, sealed plastic bag into which it is first removed from the donor. The bags, each containing a donor's specimen, are placed into conventional cup inserts and the combination is weighed. Since the amount of specimen will vary somewhat from bag to bag, in some laboratories and blood banks small additional weights are added to the cups until a uniform weight is achieved for all the cup insert-specimen bag combinations. This is achieved, in practice, by setting a weight somewhat higher than that expected for any given bag-cup combination, weighing each bag-cup separately, and adding rubber bands, rubber or plastic chips, etc., to each cup insert until the desired combined weight is achieved.

Water, or some other neutral liquid, would normally be an ideal weight-adjusting substance, since it is freely available and almost infinitely variable in weight. However, liquids are not suitable in many instances. In the case of blood bags, each bag is labelled with at least a coded label which identifies the donor, and which must not be destroyed. Water may adversely affect the legibility of parts of the coded label.

No prior art is known to the inventor which closely relates to this invention. However, the following U.S. patents are of some interest.

U.S. Pat. No. 3,851,817 discloses double walled containers for use in a centrifuge containing a liquid between the walls. However, the disclosure does not vary the amount of liquid, which is permanently sealed within the container (column 1, line 68 to column 2, line 1). The purpose of the container is for cooling blood samples, and there is no disclosure of its use for balancing. In fact, since the liquid is sealed within the container, it could not be used for the purposes of this invention.

U.S. Pat. No. 2,351,708 relates to a method of protecting glass containers and the like during centrifuging. FIG. 3 discloses a double-walled cup (container) with fluid between the walls, and the top may optionally be open (unsealed) as per page 2, right-hand column, line 15. FIG. 4 appears structurally similar to the subject invention, but only at first glance and it is noted that liquid is placed between the centrifuge receiver and the cup, separated by elastic washers. The fluid levels may be adjusted (page 2, right-hand column, line 35) but no mention is made of the use of the device to adjust the weight or balance.

U.S. Pat. No. 2,526,165 discloses double-walled containers in which a cooling liquid is placed between the walls. The liquid is sealed between the walls (column 1, line 29; column 2, lines 18–27) and the compartment is substantially filled (column 2, line 14; column 2, line 40). Thus, although the devices appear structurally related, they cannot be utilized for the purposes of the present invention.

U.S. Pat. No. 3,921,898 is of lesser interest in that it discloses a device for balancing all of the containers in a centrifuge by providing a connecting conduit with a liquid reservoir for each receiver. The balancing is automatic and is effected only when the centrifuge is operated.

SUMMARY OF THE INVENTION

This invention affords centrifuge cup inserts whose weight may be varied by adding a liquid, and methods of using such cup inserts.

In its broadest statement, this invention affords a centrifuge cup insert comprising an outer container with an inner container disposed within; spacer means for maintaining the inner container in a spaced relationship within the outer container; reservoir means located between the inner and outer containers for holding a liquid; and inlet means located between the top edges of the inner and outer container walls for permitting the insertion or removal of the liquid from the reservoir.

Various embodiments of the spacer means fall within the scope of this invention, including support struts, a rigid or non-rigid porous structure, a honeycomb, and the like. The spacer means can also comprise a solid material between the side walls provided that there is free communication between the reservoir and the atmosphere through conduit means located between the inner and outer containers.

The shapes of the inner containers and outer containers may be the same or different and are preferably coaxial. Various cylindrical circular or multifaceted containers or ellipsoidal containers all fall within the scope of this invention.

In a further embodiment of this invention, the cup insert is combined with at least one means for metering a sufficient amount of liquid into the reservoir such that the total weight of the cup insert, a specimen contained therein, and the metered liquid, reaches a predetermined amount. The metering means may comprise an electronic scale connected to an adjustable controller, which is preferably also electronic, and which is connected in turn to a liquid dispenser means operatively associated with the scale, so that the electronic controller upon receiving an electronic impulse from the scale indicating the weight of the cup insert and specimen will send an electronic impulse to the liquid dispenser causing it to dispense liquid into the cup insert inlet means until the liquid in the cup insert reservoir is sufficient that the total weight of the cup insert, the specimen, and the liquid, reaches a predetermined amount for which the controller has been pre-adjusted.

In still a further embodiment, a plurality of electronic scales may be provided, each having a liquid dispenser associated operatively therewith, wherein an electronic controller is programmed to equalize the total weight of all of the cup inserts placed upon the respective electronic scales by dispensing sufficient amounts of liquid through the dispensers so as to bring the total weight of each cup insert up to at least that of the heaviest cup insert.

This invention also affords a method of utilizing the disclosed cup inserts to balance the cups in a multi-cup centrifuge wherein at least one specimen is to be centrifuged or wherein the specimens being centrifuged are of unequal weight. Such a method in its simplest form uses one cup insert according to this invention for each cup of the centrifuge. The specimens to be centrifuged are first distributed within the cup inserts in approximately equal weight amounts. Liquid is then added to the reservoir of each cup insert in a sufficient amount so that the total weight of each cup insert (including the specimen) is about equal to the other cup inserts.

In a more sophisticated method according to this invention, wherein a metering means is utilized in connection with the cup insert, the method is as follows. Using one cup insert according to this invention for each cup of the centrifuge, the specimens to be centrifuged are distributed in approximately equal weight amounts within the various cup inserts. The liquid metering means is then permitted to add a liquid to the reservoir of each cup insert in a sufficient amount so that the total weight of each cup insert is about equal. As a variant of this method, an amount of liquid would be added so that the total weight of each of the cup inserts reaches a predetermined amount which is greater than that which would be expected for the heaviest cup insert and specimen that is to be centrifuged.

Where a plurality of cup inserts are to be balanced simultaneously, either all of the cup inserts to be used in a given centrifuge run or a sufficient number of cups to be used in successive centrifuge runs, the cup inserts are placed upon a plurality of electronic scales, each of which has a liquid dispensing means operatively associated therewith. The electronic impulse from the electronic scale is sent to a controller, preferably an electronic controller, most preferably a programmed microprocessor, which then sends signals to the various liquid dispensing means so as to cause varying amounts of liquid to be added to each cup insert, until all of the cup inserts have the same total weight. The total weight may be either that of the heaviest cup insert and specimen or may be a predetermined amount in excess of the weight of the heaviest cup and specimen.

BRIEF DESCRIPTION OF THE DRAWINGS

FIG. 3 illustrates an embodiment in which the spacer means is a porous structure permitting the free flow of water and in which both the inner and outer containers have a generally square configuration in horizontal cross-section.

FIG. 4 illustrates an embodiment in which the spacer means is a solid material between the side walls of the inner and outer containers and in which conduit means communicate between the reservoir and the atmosphere. This embodiment also has a channel at the upper end of the inner and outer container side walls for directing the liquid into the conduit means.

DETAILED DESCRIPTION OF THE INVENTION

The centrifuge cup inserts of this invention comprise an outer container, an inner container disposed within the outer container, spacer means for maintaining the inner and outer containers in a spaced relationship with each other, reservoir means located between the inner and outer containers for holding a liquid, and inlet means permitting the reservoir means to communicate with the atmosphere, the inlet means preferably being located between the top edges of the inner and outer container walls.

The shape of the inner and outer containers is not critical, although there are certain practical considerations. The outer container configuration should be one which corresponds to the inner surface of the centrifuge cup. Centrifuge cups vary in shape, but generally are cylindrical with a circular cross-section and have rounded bottoms. Frequently centrifuge cups also contain a groove or chamfer so as to orient a cup insert which is fitted within the centrifuge cup. Other centrifuge cups may have horizontal cross-sections which are ellipsoidal, polygonal, or irregular. The outer configuration of the outer container of the cup insert of this invention does not form a part thereof and therefore may be any shape which is adapted to fit within the cups of a centrifuge. The inner container of the centrifuge cup insert of this invention is generally coaxial with the outer container and preferably has the same configuration. However, the configuration of the inner container can be different than that of the outer container where specimens of a particular form are to be centrifuged, and therefore is not a critical aspect of this invention. The preferred shape of the inner container is a cylinder with a circular horizontal cross-section although an ellipsoidal horizontal cross-section may be desired where the outer container also has an ellipsoidal horizontal cross-section.

FIG. 1 is a stylized showing of horizontal cross-sections of various outer container and inner container combinations. FIG. 1(A) shows a cylindrical inner container 12 within a cylindrical outer container 11. FIG. 1(B) shows an ellipsoidal inner container within an ellipsoidal outer container. FIG. 1(C) shows a square inner container within a square outer container. FIG. 1(D) shows an outer container truncated by a planar surface 13 and a correspondingly shaped inner container. In FIG. 1(E) the outer container is truncated by a planar surface 13 but the inner container is circular. In FIG. 1(F) the outer container is truncated by two planar surfaces 13, 13' but the inner container is circular in horizontal cross-section. In FIG. 1(G) the outer container is square and the inner container is circular. In FIG. 1(H) the outer container is circular and the inner container is square. In FIG. 1(I) the outer container is a polygon and the inner container is circular. In FIG. 1(J) both the outer and inner containers are corresponding polygons.

Figure 1A:
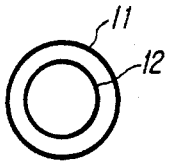
FIG. 1 is a top planar view of various cup insert outer containers and associated inner containers, showing the different configurations that these containers may take.
Figure 1B:
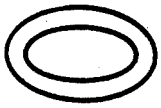
Figure 1C:
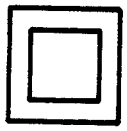
Figure 1D:
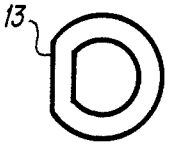
Figure 1E:
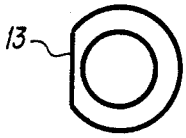
Figure 1F:
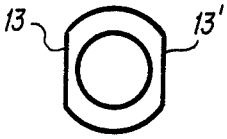
Figure 1G:
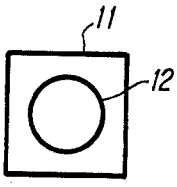
Figure 1H:
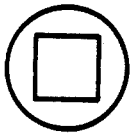
Figure 1I:
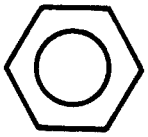
Figure 1J:
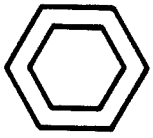
Figure 2A:
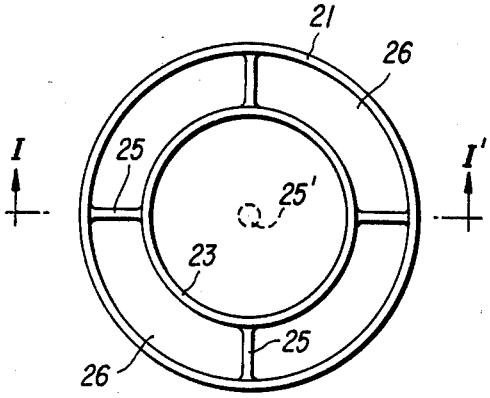
FIG. 2 illustrates a cup insert embodiment in which the spacer means are struts, FIG. 2(A) being a top planar view and FIG. 2(B) being a cross-section through line I—I' of FIG. 2(A).
Figure 2B:
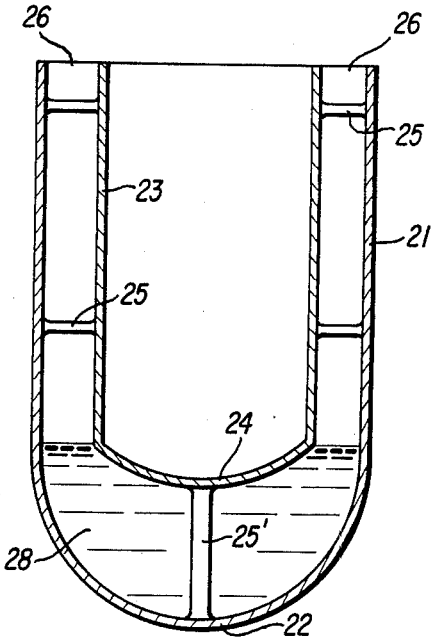
Figure 3A:
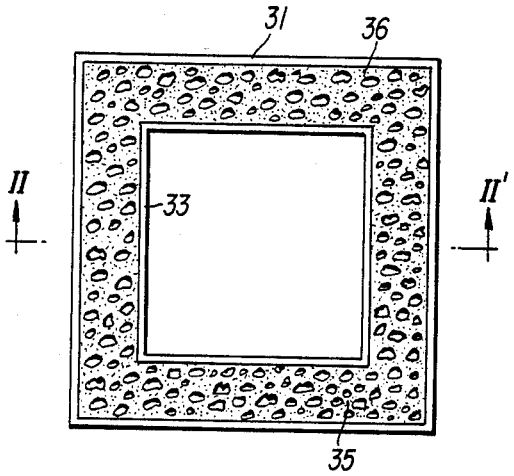
FIG. 3(A) is a top planar view and FIG. 3(B) is a cross-section taken through line II—II' of FIG. 3(A).
Figure 3B:
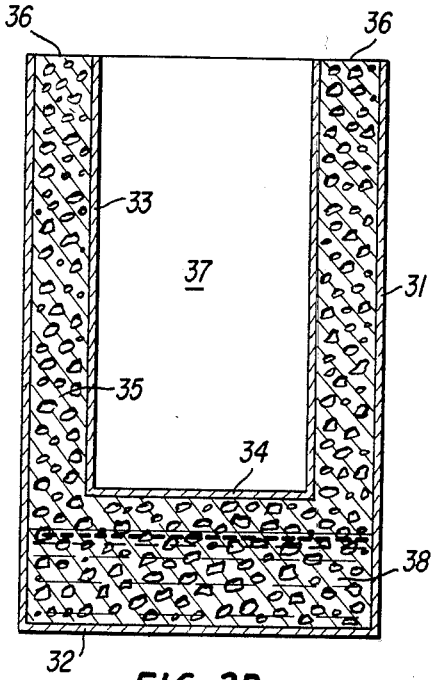
Figure 4A:
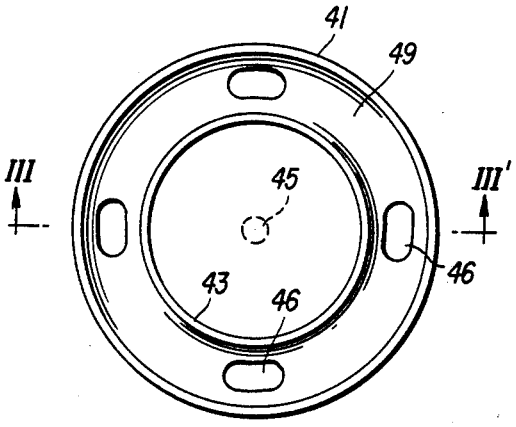
FIG. 4(A) is a top planar view and FIG. 4(B) is a cross-section taken through line III—III' of FIG. 4(A).
Figure 4B:
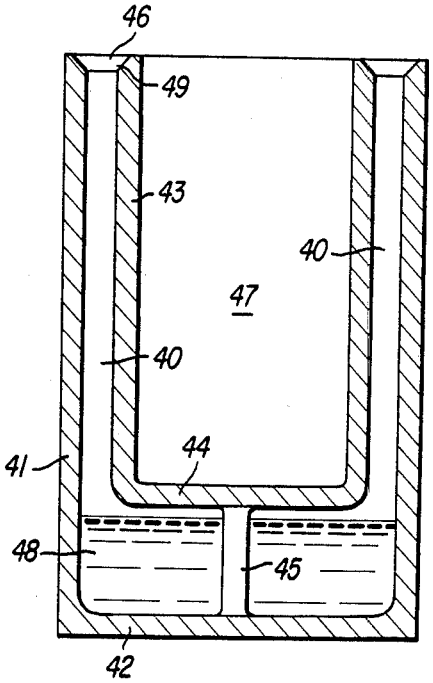

The bottom of the outer containers may be either generally flat (as shown in FIGS. 3 and 4) or curved, preferably hemispherical (as shown in FIG. 2). The bottom of the inner container need not correspond in configuration with that of the outer container and may either be generally flat (as in FIGS. 3 and 4) or slightly curved (as in FIG. 2) or hemispherical.

The inner and outer container walls according to this invention may be fabricated of the same material or different materials. A high impact plastic is generally preferred, which may be either thermosetting or thermoplastic. The containers also may be of metal or glass where desired. The material from which the inner and outer containers are fabricated does not form a part of this invention.

The spacer means may also be formed of various materials depending upon the embodiment of this invention that is being utilized. Similarly to the containers, the spacer means may be fabricated of various types of plastic or metal and the material forms a part of this invention only to the extent that the material used affords the physical properties required for maintaining the inner and outer containers in permanent spaced relationship, despite the forces that may be encountered during centrifuging.

In the embodiment of FIG. 2, an inner container having side wall 23 and bottom 24 is disposed within an outer container having side wall 21 and bottom 22. In this particular embodiment the containers are circular in horizontal cross-section as shown in FIG. 2A. The spacer means comprise a plurality of support struts 25 which are disposed between inner cylinder wall 23 and outer cylinder wall 21, preferably substantially perpendicular to the respective surfaces to which the struts are attached. At least one strut 25' is disposed between outer container bottom 22 and inner container bottom 24, so that the centrifugal force generated by the centrifuge will not rupture the remaining support struts 25. The struts shown in FIG. 2 are at 90° intervals to the central axis, but it is not intended that this invention be limited to any particular placement of such struts. The number of struts utilized will depend upon the strength of the materials used, the size of the centrifuge cup insert, the g-force at which the centrifuge is operated, and the specimens being subjected to centrifugation. It is therefore not possible to specify the number of support struts other than to state that they must be a plurality. The reservoir means 28 are lined to show a liquid and the inlet means 26 permit free communication between the reservoir means and the atmosphere through inlets located between the top edges of the inner and outer container walls. The use of support struts as the spacer means is not dependent upon the configuration of either the outer container or the inner container and may be used, for example, with any of the configuration combinations shown in FIG. 1.

FIG. 3 illustrates an embodiment in which the inner and outer containers are in the shape of rectangular solids. Thus inner container walls 33 form planar surfaces that are parallel to outer container walls 31 and inner container bottom 34 also is a planar surface approximately parallel to outer container bottom 32. In FIG. 3, the spacer means comprises a rigid porous structure between the inner and outer containers, the openings of which structure are large enough to permit the free passage of liquid with not more than minimal capillary effects and wherein the reservoir means 38 comprises the free space within the structure. FIG. 3 illustrates liquid partially occupying the reservoir means 38. The inlet means 36 are located between the top edges of the inner and outer container walls and permit free communication between the reservoir 38 and the atmosphere. The material from which the porous structure is fabricated is not critical, except that it should be sufficiently rigid and strong to support the inner container within the outer container while the centrifuge is being used.

As a further embodiment of this invention (not shown), the spacer means of FIGS. 2 and 3 may be combined, in that support struts may be utilized with a non-rigid porous structure, such as a plastic sponge, located in the free space between the containers not occupied by the struts. The non-rigid porous material must have pores of sufficient size that they afford only minimal capillary action, so that the liquid in the reservoir may be removed by pouring it out from the cup insert, without the use of any force other than gravity.

It should be noted that the shape of the containers in FIG. 3 is unrelated to the nature of the spacer means, and that any of the configurations of FIG. 1 may have the same spacer means as illustrated in FIG. 3.

FIG. 4 is an embodiment wherein the spacer means comprises a solid material between the side walls 43 of the inner container and side walls 41 of the outer container. The reservoir means 48 comprises a space between the bottom 44 of the inner container and the bottom 42 of the outer container. The inlet means 46 communicate with at least one conduit 40 which further communicates with the reservoir 48 so that the reservoir 48 is freely open to the atmosphere. In a preferred embodiment, an annular channel 49 is provided between the top edges of the inner and outer containers, for channeling liquid to the at least one conduit. The number of conduits may vary, and depends upon the rapidity with which the water is to be added to or removed from the reservoir. In the embodiment shown in FIG. 4, four conduits are provided. Additionally, a support strut 45 is provided between the bottom of the outer container 42 and the bottom of the inner container 44. More than one support strut may be utilized where desired.

The fabrication of the embodiment of FIG. 4 may be done in any number of conventional manners, such as by molding the entire cup insert other than outer cup bottom 42 in one piece and molding outer cup bottom 42 separately and fastening them together, or by forming the inner cup separately from the outer cup and fixing the cups together. The material forming the spacer may be the same as or different than the material forming the inner and outer cups.

Figure 5:
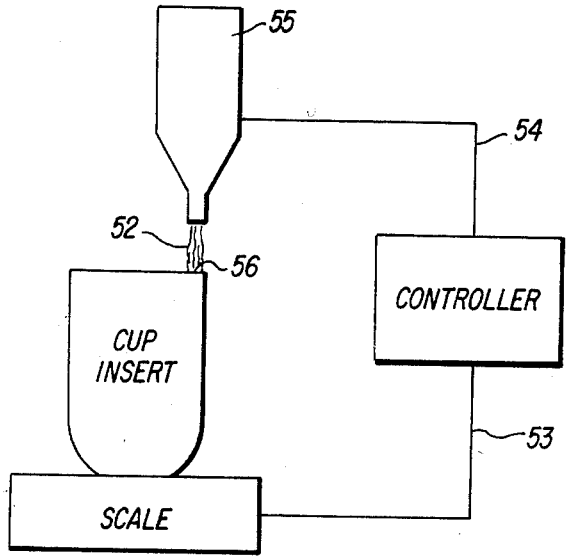
FIG. 5 is a flow diagram illustrating the embodiment of this invention wherein a cup insert is weighed on an electronic scale which sends an impulse to a controller means which in turn sends an impulse to a liquid dispensing means so as to dispense a metered amount of liquid to be added to the cup insert reservoir.

FIG. 5 illustrates a further embodiment of this invention in which a cup insert as described above is utilized in combination with a scale (preferably an electronic scale) a means 55 for metering liquid 52 so that it may be introduced into the inlet 56 of the cup insert, a controller, and communication means 53 between the scale and the controller and second communication means 54 between the controller and the liquid dispensing means 55. Preferably, the scale is an electronic scale which sends an electrical impulse through an electrical conductor 53 to the controller which is a microprocessor, and which itself sends an electrical impulse through a second electrical conductor 54 to the liquid dispenser 55. The electrical impulse sent by the electronic controller activates the liquid dispenser 55 so that it dispenses a metered amount of liquid 52. Once the electronic controller is preset, the scale and liquid dispensing means may be considered to be operatively associated with each other. The liquid dispensing means may be any conventional means such as a roller pump or a liquid reservoir with an operable outlet valve. The nature of the liquid dispensing means, the controller, or the scale, do not in themselves form a part of this invention, but rather only when taken in combination with the cup inserts afforded herein.

Figure 6:
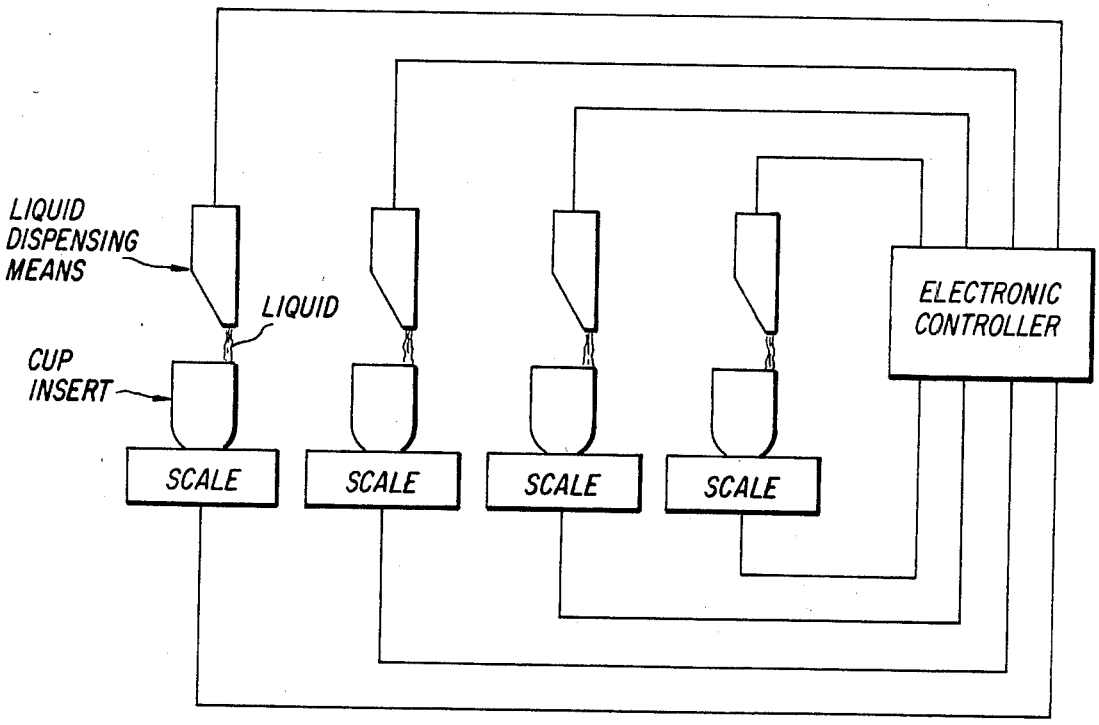
FIG. 6 illustrates a flow diagram for a plurality of cup inserts being weighed upon a plurality of electronic scales having operatively associated liquid dispensing means.

FIG. 6 is a flow diagram illustrating a means for balancing a plurality of cup inserts in accordance with this invention. Essentially FIG. 6 corresponds to FIG. 5 except that each scale and its associated liquid dispensing means are operated through an electronic controller which may be programmed to meter the amount of liquid dispensed in varying amounts depending upon the total weight of the cup insert and specimen in each instance.

Thus, this invention affords the combination of the cup insert described previously with at least the means for metering a sufficient amount of liquid into the reservoir of the cup insert such that the total weight of the cup insert (with or without a specimen contained therein) and the metered liquid, reaches a predetermined amount. In a further embodiment, this invention further affords a metering means comprising an electronic scale connected to an adjustable electronic controller such as a microprocessor, connected in turn to a liquid dispenser operatively associated with said scale, so that when the electronic controller receives an electronic impulse from the scale indicating the weight of the cup insert and specimen, it sends a second electronic impulse to the liquid dispenser causing it to dispense liquid into the cup insert inlet means until the liquid in the cup insert reservoir is sufficient that the total weight of the cup insert, the specimen (if any) and the liquid, reaches a predetermined amount for which the electronic controller has been pre-adjusted.

In still a further embodiment, a plurality of electronic scales is provided, each having a liquid dispenser associated operatively therewith, wherein the electronic controller is programmed to equalize the total weight of all of the cup inserts by dispensing sufficient amounts of liquid through the dispensers so as to bring the total weight of each cup insert up to at least that of the heaviest cup insert.

This invention also affords a method of using the cup inserts provided herein with or without the associated apparatus further described. In its broadest form, the invention affords a method of balancing the cups in a multi-cup centrifuge wherein at least one specimen is to be centrifuged or wherein the specimens are of unequal weight, comprising utilizing a cup insert as described herein for each cup of the centrifuge, distributing the specimens to be centrifuged in approximately equal weight amounts within the cup inserts (where such distribution is possible), and adding a liquid to the reservoir of each cup insert in a sufficient amount so that the total weight of each cup insert is about equal to that of the other cup inserts.

In a further embodiment of this invention, the liquid is added to the reservoir by means of a liquid metering means which meters liquid in a sufficient amount so that the total weight of each cup insert is about equal.

In still a further embodiment of this invention, an electronic scale controller and liquid dispersing means as described herein are used and the electronic controller is adjusted to control dispensing liquid to each cup insert until its total weight reaches a predetermined amount after which the cup insert is placed upon the electronic scale so that its inlet is beneath the liquid dispenser which is then permitted to add liquid to the cup insert's reservoir until the desired total weight is reached.

In still another embodiment of this invention in which the apparatus of FIG. 6 is utilized, a number of cup inserts at least equal to the number of centrifuge cups are placed upon separate electronic scales, and the electronic controller is permitted to control the dispensing of metered amounts of liquid to the various cup insert reservoirs until the total weight of each cup is equal to the total weight of the heaviest cup. Alternatively, the electronic controller means may be preset so that liquid is added to the cup insert having the heaviest weight in a preset amount, for example a percentage of its total weight, and all of the remaining (lighter) cups have liquid added until they reach the weight of the heaviest cup. In all instances, the total weight of each cup insert, specimen, and added liquid, must be approximately equal to the total weight of every other cup insert. The tolerance of weight variation will vary with the type of specimen being centrifuged.

The liquid utilized in this invention is preferably water. However, there may be instances in which a less dense liquid is preferred so as to afford a more delicate weight adjustment using a given apparatus. Additionally, there may be instances in which the weight of the specimens being centrifuged is so great that it is necessary to use a denser liquid in order to reach a desired total weight.

Although the entire free space between the inner container and the outer container constitutes the liquid reservoir, it is generally preferred that the liquid be entirely contained within the space between the bottom of the inner cup and the bottom of the outer cup.

It is also possible to seal temporarily the inlet means of the cup insert, to avoid accidental spillage. However, a permanent sealing of the inlet means will render the cup inserts of this invention useless for their contemplated purpose, since adjustments to the weight can then no longer be made.

I claim:

1. A centrifuge cup insert for use in said centrifuge, said cup insert comprising:

an outer container having a wall and bottom;

an inner container having a wall and bottom disposed within the outer container;

rigid spacer means for maintaining the inner container in a fixed spaced relationship with the outer container, said spacer means being sufficiently strong to withstand forces encountered during operation of said centrifuge;

weight adjustment means for selectively adjusting the overall weight of said cup insert to maintain balance in said centrifuge by adding and removing liquid in said cup insert, said weight adjustment means comprising reservoir means located between the inner and outer containers for holding said liquid; and inlet means located between the top edges of the inner and outer container walls for permitting the insertion and removal of the liquid from the reservoir means;

wherein the spacer means comprises a rigid porous structure between the inner and outer containers, the openings of which structure a large enough to permit free passage of liquid with not more than minimal capillary effects, and wherein the reservoir means comprises the free space within the structure.

2. The cup insert of claim 1 wherein the walls of the containers are substantially cylindrical and the containers are coaxial.

3. The cup insert of claim 1 wherein the walls of the containers are substantially ellipsoidal in horizontal cross-section and the containers are coaxial.

4. A centrifuge cup insert for use in said centrifuge, said cup insert comprising:

an outer container having a wall and bottom;

an inner container having a wall and bottom disposed within the outer container;

rigid spacer means for maintaining the inner container in a fixed spaced relationship with the outer container, said spacer means being sufficiently strong to withstand forces encountered during operation of said centrifuge;

weight adjustment means for selectively adjusting the overall weight of said cup insert to maintain balance in said centrifuge by adding and removing liquid in said cup insert, said weight adjustment means comprising reservoir means located between the inner and outer containers for holding said liquid; and inlet means located between the top edges of the inner and outer container walls for permitting the insertion and removal of the liquid from the reservoir means;

and further comprising at least one means for metering a sufficient amount of liquid into the reservoir such that the total weight of the cup insert, a specimen contained therein, and the metered liquid, reaches a predetermined amount.

5. The combination of claim 4 wherein the metering means comprises an electronic scale connected to an adjustable electronic controller connected in turn to a liquid dispenser operatively associated with said scale, so that the electronic controller receives an electronic impulse from the scale indicating the weight of the cup insert and specimen and sends an electronic impulse to the liquid dispenser to dispense liquid into the cup insert inlet means until the liquid in the cup insert reservoir is sufficient that the total weight of the cup insert, the specimen, and the liquid, reaches a predetermined amount for which the electronic controller has been pre-adjusted.

6. The combination of claim 5 wherein a plurality of electronic scales is provided, each having a liquid dispenser associated operatively therewith, and wherein the electronic controller is programmed to equalize the total weight of all of the cup inserts by dispensing sufficient amounts of liquid through said dispensers to bring the total weight of each cup insert up to at least that of the heaviest cup insert.

7. A method of balancing the cups in a multi-cup centrifuge wherein at least one specimen is centrifuged or wherein specimens are of unequal weight, comprising:

using one cup insert for each cup of the centrifuge comprising: an outer container having a wall and bottom; an inner container having a wall and bottom disposed within the outer container; rigid spacer means for maintaining the inner container in a fixed spaced relationship within the outer container; reservoir means located between the inner and outer containers for holding a liquid; and inlet means located between the top edges of the inner and outer container walls for permitting the insertion or removal of the liquid from the reservoir;

distributing the specimens to be centrifuged approximately equally within the cup inserts; and adding a liquid to the reservoir of each cup insert in a sufficient amount so that the total weight of each cup insert is about equal.

8. A method of balancing the cups in a multi-cup centrifuge wherein at least one specimen is centrifuged or wherein specimens are of unequal weight, comprising:

using one cup insert for each cup of the centrifuge comprising: an outer container having a wall and bottom; an inner container having a wall and bottom disposed within the outer container; rigid spacer means for maintaining the inner container in a fixed spaced relationship within the outer container; reservoir means located between the inner and outer containers for holding a liquid; and inlet means located between the top edges of the inner and outer container walls for permitting the insertion or removal of the liquid from the reservoir; in combination with at least one means for metering a sufficient amount of liquid into the reservoir such that the total weight of the cup insert, a specimen contained therein, and the metered liquid, reaches a predetermined amount;

distributing the specimens to be centrifuged approximately equally within the cup inserts; and permitting the liquid metering means to add a liquid to the reservoir of each cup insert in a sufficient amount so that the total weight of each cup insert is about equal.

9. A method of balancing the cups in the multi-cup centrifuge wherein at least one specimen is centrifuged or wherein specimens are of unequal weight, comprising:

using one cup insert for each cup of the centrifuge comprising: an outer container having a wall and bottom; an inner container having a wall and bottom disposed within the outer container; rigid spacer means for maintaining the inner container in a fixed spaced relationship within the outer container; reservoir means located between the inner and outer containers for holding a liquid; and inlet means located between the top edges of the inner and outer container walls for permitting the insertion or removal of the liquid from the reservoir; in combination with at least one means for metering a sufficient amount of liquid into the reservoir such that the total weight of the cup insert, a specimen contained therein, and the metered liquid, reaches a predetermined amount; wherein the metering means comprises an electronic scale connected to an adjustable electronic controller connected in turn to a liquid dispenser operatively associated with said scale, so that the electronic controller receives an electronic impulse from the scale indicating the weight of the cup insert and specimen and sends an electronic impulse to the liquid dispenser to dispense liquid into the cup insert inlet means until the liquid in the cup insert reservoir is sufficient that the total weight of the cup insert, the specimen, and the liquid, reaches a predetermined amount for which the electronic controller has been pre-adjusted;

distributing the specimens to be centrifuged approximately equally within the cup inserts;

adjusting the electronic controller to control dispensing liquid to each cup insert until its total weight reaches a predetermined amount; and placing the cup insert upon the electronic scale and permitting the liquid dispenser to add liquid to the cup insert's reservoir until the desired total weight is reached.

10. A method of balancing all of the cups in a multicup centrifuge wherein at least one specimen is centrifuged or wherein specimens are of unequal weight, comprising:

using one cup insert for each cup of the centrifuge comprising: an outer container having a wall and bottom; an inner container having a wall and bottom disposed within the outer container; rigid spacer means for maintaining the inner container in a fixed spaced relationship within the outer container; reservoir means located between the inner and outer containers for holding a liquid; and inlet means located between the top edges of the inner and outer container walls for permitting the insertion or removal of the liquid from the reservoir; in combination with at least one means for metering a sufficient amount of liquid into the reservoir such that the total weight of the cup insert, a specimen contained therein, and the metered liquid, reaches a predetermined amount; wherein the metering means comprises an electronic scale connected to an adjustable electronic controller connected in turn to a liquid dispenser operatively associated with said scale, so that the electronic controller receives an electronic impulse from the scale indicating the weight of the cup insert and specimen and sends an electronic impulse to the liquid dispenser to dispense liquid into the cup insert inlet means until the liquid in the cup insert reservoir is sufficient that the total weight of the cup insert, the specimen, and the liquid, reaches a predetermined amount for which the electronic controller has been pre-adjusted; and further wherein a plurality of electronic scales is provided, each having a liquid dispenser associated operatively therewith, and wherein the electronic controller is programmed to equalize the total weight of all of the cup inserts by dispensing sufficient amounts of liquid through said dispensers to bring the total weight of each cup insert up to at least that of the heaviest cup insert;

distributing the specimens to be centrifuged approximately equally within the cup inserts;

placing a number of the cup inserts at least equal to the number of centrifuge cups upon separate electronic scales; and permitting the electronic controller to control the dispensing of metered amounts of liquid to the various cup insert reservoirs until the total weight of each cup is equal.

* * * * *